US007762427B2

(12) United States Patent
Sawicki

(10) Patent No.: US 7,762,427 B2
(45) Date of Patent: Jul. 27, 2010

(54) PUMP DISPENSING MECHANISM

(75) Inventor: Craig Sawicki, Elk Grove Village, IL (US)

(73) Assignee: Kranson Industries, Inc., Clarendon Hills, IL (US)

( * ) Notice: Subject to any disclaimer, the term of this patent is extended or adjusted under 35 U.S.C. 154(b) by 915 days.

(21) Appl. No.: 11/423,324

(22) Filed: Jun. 9, 2006

(65) Prior Publication Data

US 2006/0278662 A1 Dec. 14, 2006

Related U.S. Application Data

(60) Provisional application No. 60/689,765, filed on Jun. 10, 2005.

(51) Int. Cl.
*B65D 88/54* (2006.01)

(52) U.S. Cl. ..... 222/1; 222/321.1; 222/324; 239/333

(58) Field of Classification Search ..... 604/214; 128/200.18; 239/333; 222/182, 321.1–321.9, 222/402.11–402.13, 1, 323–324
See application file for complete search history.

(56) References Cited

U.S. PATENT DOCUMENTS 1,641,003 A * 8/1927 Lang ..... 222/321.6
2,796,204 A * 6/1957 Math ..... 222/324
2,837,247 A * 6/1958 Stewart et al. ..... 222/321.9
2,906,265 A * 9/1959 Samuels ..... 128/200.23
4,286,736 A 9/1981 Corsette
4,318,498 A 3/1982 Magers et al.
4,410,107 A 10/1983 Corsette
4,458,832 A 7/1984 Corsette
4,524,888 A 6/1985 Tada
4,801,049 A 1/1989 Thompson
4,809,878 A 3/1989 Rainey
4,944,429 A * 7/1990 Bishop et al. ..... 222/153.13
5,215,227 A * 6/1993 Farner ..... 222/175
5,271,530 A 12/1993 Uehira et al.
5,287,996 A 2/1994 Uhlig
D355,491 S * 2/1995 Monea ..... D24/200
5,431,155 A * 7/1995 Marelli ..... 128/200.14
5,443,569 A 8/1995 Uehira et al.
5,570,819 A 11/1996 Uehira et al.
5,738,250 A 4/1998 Gillingham et al.

(Continued)

FOREIGN PATENT DOCUMENTS

WO WO 0010910 3/2000

OTHER PUBLICATIONS

PCT International Search Report, PCT/US2006/022522.

*Primary Examiner*—Kevin P Shaver
*Assistant Examiner*—Andrew P Bainbridge
(74) *Attorney, Agent, or Firm*—H. Frederick Rusche; Husch Blackwell Sanders LLP

(57) ABSTRACT

A fluid dispenser includes a container having a body portion and an upwardly extending cylindrical wall. The body portion is suitable for containing a fluid. A pump dispenser is connected to the container at the upwardly extending cylindrical wall and includes an actuator head with a spout, a stem connected to the actuator head, and a handle connected to the stem. The handle has at least one first depression member and at least one other depression member. The handle is depressed to withdraw at least a portion of the fluid from the container and dispense at least a portion of the fluid at the spout.

1 Claim, 5 Drawing Sheets

U.S. PATENT DOCUMENTS 5,836,922 A * 11/1998 Hansen et al. ..... 604/214
5,881,927 A 3/1999 Inagawa
5,899,363 A 5/1999 Bliss, III et al.
6,045,008 A 4/2000 Gonzalez Fernandez et al.
6,065,640 A 5/2000 Ho et al.
6,105,830 A 8/2000 Inagawa
6,138,870 A 10/2000 Lin
6,193,106 B1 2/2001 Ho et al.
6,223,954 B1 5/2001 Carow
6,308,865 B1 10/2001 Lin
6,334,549 B1 1/2002 Fernandez et al.
6,364,167 B1 4/2002 Safian et al.
6,364,170 B1 * 4/2002 Anderson et al. ..... 222/321.7
6,386,397 B2 * 5/2002 Brotspies et al. ..... 222/321.6
6,422,425 B1 7/2002 Tada
6,439,440 B1 * 8/2002 Lasserre ..... 222/402.21
RE37,903 E * 11/2002 Riskin ..... 222/23
6,533,144 B2 3/2003 Davies et al.
6,543,649 B1 4/2003 Danielo et al.
6,772,915 B2 * 8/2004 Helmlinger ..... 222/153.13
RE38,816 E * 10/2005 Baudin ..... 222/546
RE38,826 E * 10/2005 Nakashiba et al. ..... 451/41
7,047,802 B2 5/2006 Seys et al.
2005/0161475 A1 * 7/2005 Kaga ..... 222/321.7

* cited by examiner

PUMP DISPENSING MECHANISM

CROSS-REFERENCE TO RELATED APPLICATIONS

This application claims the priority of provisional application Ser. No. 60/689,765, filed Jun. 10, 2005.

BACKGROUND OF THE INVENTION

1. Field of the Invention

The present invention relates to fluid dispensers and, more particularly, to dispensers for liquid soaps and similar products.

2. Related Art

Liquid soaps and products of a similar type are sold to consumers in a variety of different types of containers. The soap or other product is typically contained in a container having a pump actuator head that is depressed to dispense the product onto the hand of the user. The containers can be a wide variety of shapes, and there are different actuator heads and pumping means available, but the dispensers all operate on similar principles, with the actuator head being depressed, the product being drawn up a feed tube and dispensed through a spout or nozzle in the actuator head and onto the user's hand.

The dispensers are generally simple and convenient to use but can cause problems when a consumer tries to operate the actuator head and dispense the contents with only one hand, with the other hand being unavailable to provide support to the dispenser, possibly because of stickiness, greasiness or other problems, or simply because the user simply desires to use only one hand for dispensing the composition. In particular, many of the designs of dispenser containers are not sufficiently stable, especially when they have been emptied to a significant extent, to enable a consumer to operate the actuator head without using the other hand to support the dispenser to prevent it tipping or moving during operation of the actuator head.

Therefore, there is a need in the art for a pump dispenser that allows effective one-handed operation of a fluid dispenser.

SUMMARY OF THE INVENTION

The invention is a pump dispenser for one-hand operation. Current fluid pumps are designed to be pushed down with the palm of one hand while holding the other hand under the nozzle. Thus, one hand is used to dispense the fluid and the other hand receives the dispensed fluid. The present invention allows one handed operation of the pump dispenser because a user can push down with the back of the fingers and dispense the fluid into the same hand. One-handed operation of the present invention allows the user's other hand to be free for other tasks.

The pump dispenser has an actuator head for the dispensing of a high viscosity fluid, such as soap or lotion. The actuator head is actuated through the use of a handle having at least two depression members. A user places his or her hand near the actuator head palm-side up, with the palm beneath the dispenser spout, and simultaneously places a finger on each handle depression member. The user uses his or her fingers to depress the handle to dispense the fluid. The structure of the actuator head and the handle conveniently allow for one-hand operation. As an example, the pump dispenser may be connected to a container to form a fluid dispenser.

In one embodiment, the handle is saddle-shaped and has two arcuate surfaces. Each arcuate surface is adapted and sized to receive a user's finger. In other words, each surface is concave and upwardly disposed to support the user's fingers. The user uses his or her fingers to depress the arcuate surfaces to actuate the pump dispenser.

In another embodiment, the handle has two paddles. Each paddle has a gripping surface. The user places his or her fingers on the gripping surfaces in order to depress the handle and actuate the pump dispenser.

Thus, in furtherance of the above goals and advantages, the present invention is, briefly, a pump dispenser adapted to connect to a container, the pump dispenser including an actuator head with a spout, a stem connected to the actuator head, and a handle connected to the stem, the handle having at least one first depression member and at least one other depression member, wherein the handle is depressed to withdraw at least a portion of a fluid from the container and dispense at least a portion of the fluid at the spout.

Further, the present invention is, briefly, a method of operating a fluid dispenser, the method comprising the steps of: providing a pump dispenser connected to a container, the pump dispenser having an actuator head with a spout, a stem connected to the actuator head, and a handle connected to the stem, the handle having at least one first depression member and at least one other depression member, and the container containing a fluid; placing a first finger over the at least one first depression member; placing a second finger over the at least one other depression member; depressing the handle with the first finger and the second finger; withdrawing at least a portion of the fluid from the container; and dispensing at least a portion of the fluid at the spout.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
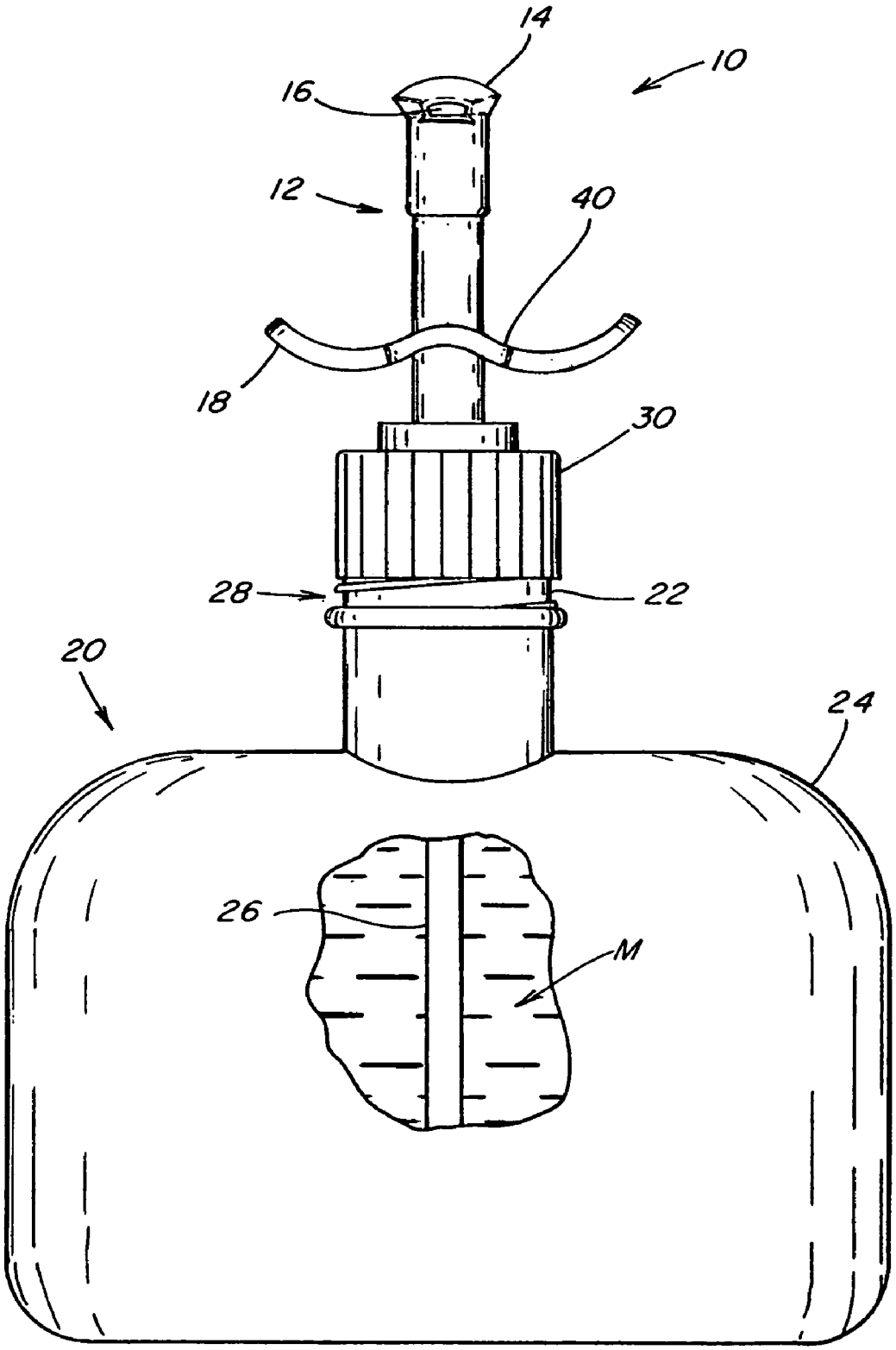
FIG. 1 is a front elevation view partially broken away of a fluid dispenser incorporating one embodiment of a pump dispenser of the present invention.

FIG. 1 illustrates a fluid dispenser 10 having a pump dispenser 12 and a container 20. The container 20 has a body portion 24 and an upwardly extending, cylindrical wall 22 connected to the body portion 24. The pump dispenser 12 is connected to the container 20 at the cylindrical wall 22. In the depicted embodiment, the cylindrical wall 22 has threads 28 and the pump dispenser 12 has a cap or closure 30 with corresponding internal threads (not shown). However, those skilled in the art would understand that other methods of connecting the pump dispenser 12 to the container 20 may be employed.

The body portion 24 holds a high viscosity fluid M, such as liquid soap, shampoo, conditioner, lotion or the like. In the depicted embodiment, the body portion 24 is made of lightweight plastic and is transparent. In some embodiments, the body portion 24 may be transparent or opaque depending upon the desired aesthetics of the design. A pickup tube 26 extends into the body portion 24 and extends up to the pump dispenser 12. The high viscosity fluid M travels from the body portion 24 and up the pickup tube 26 upon actuation of the pump dispenser 12.

The pump dispenser 12 includes an actuator head 14 having a spout 16 and a handle 18. The handle 18 is connected to the actuator head 14 via a stem 40. In the depicted embodiment, the handle 18 is integrally formed with the stem 40. The stem 40 is hollow and is in fluid communication with the actuator head 14. A user depresses the handle 18 to actuate the pump dispenser 12. When the handle 18 is depressed, the high viscosity fluid M travels from the body portion 24, up the pickup tube 26, up the stem 40, into the actuator head 14, and out the spout 16.

Figure 2:
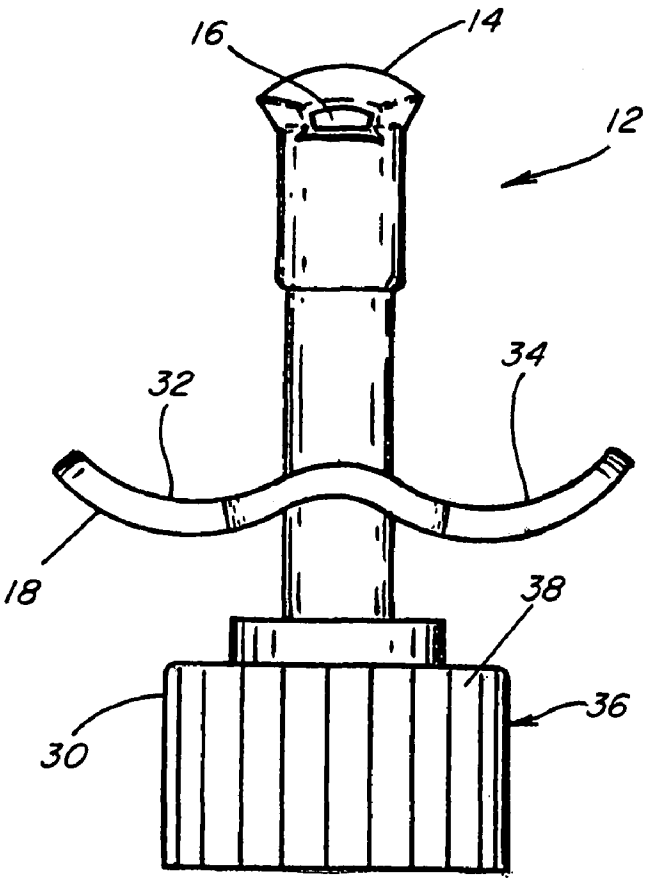
FIG. 2 is a front elevation view of a pump dispenser of the present invention in a first embodiment.

FIG. 2 illustrates the pump dispenser 12 with the handle 18 in a first embodiment. In the embodiment depicted in FIG. 2, the handle 18 is saddle-shaped or wing-shaped with the concave surface facing upwardly during use. In the depicted embodiment, the handle 18 has two depression members. The depression members are provided in the form of a first arcuate surface 32 and a second arcuate surface 34. The arcuate surfaces 32, 34 are each shaped and sized to receive a finger of a user's hand. In other words, the handle 18 is ergonomically shaped to comfortably fit two fingers for a majority of the population. Additionally, the cap 30 has a closure surface 36, and, in the depicted embodiment, vertical slits or grooves 38 are cut or molded into the closure surface 36. The vertical slits 38 are preferred to enhance the closure surface 38 by making it easier to grasp but are not a requirement of the invention.

Figure 3:
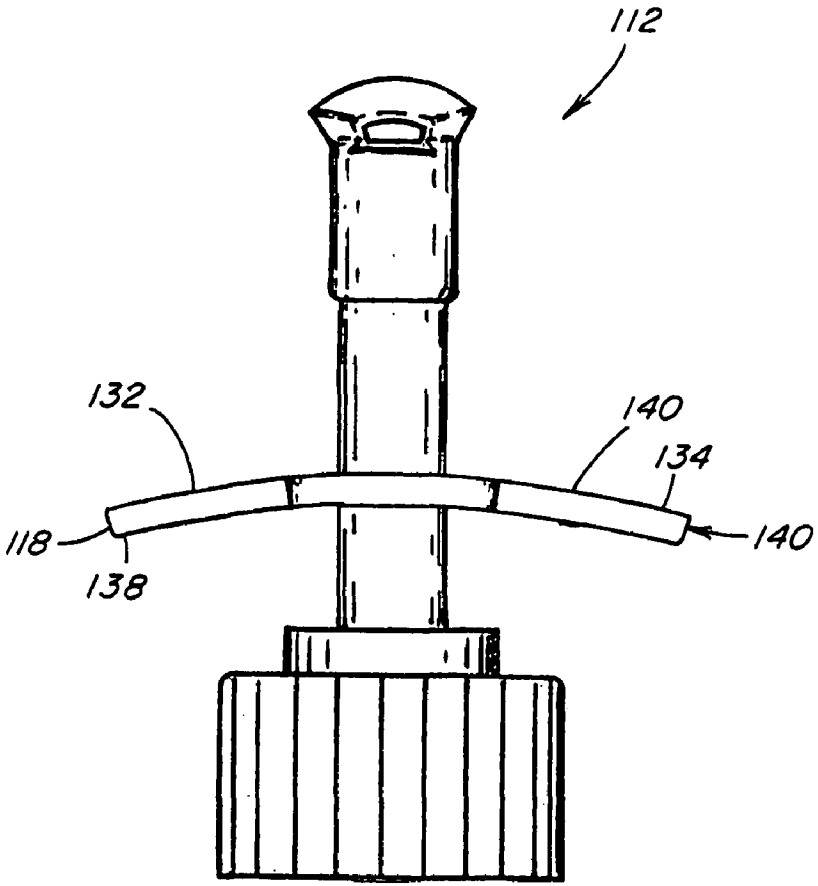
FIG. 3 is a front elevation view of a pump dispenser of the present invention in a second embodiment.
Figure 4:
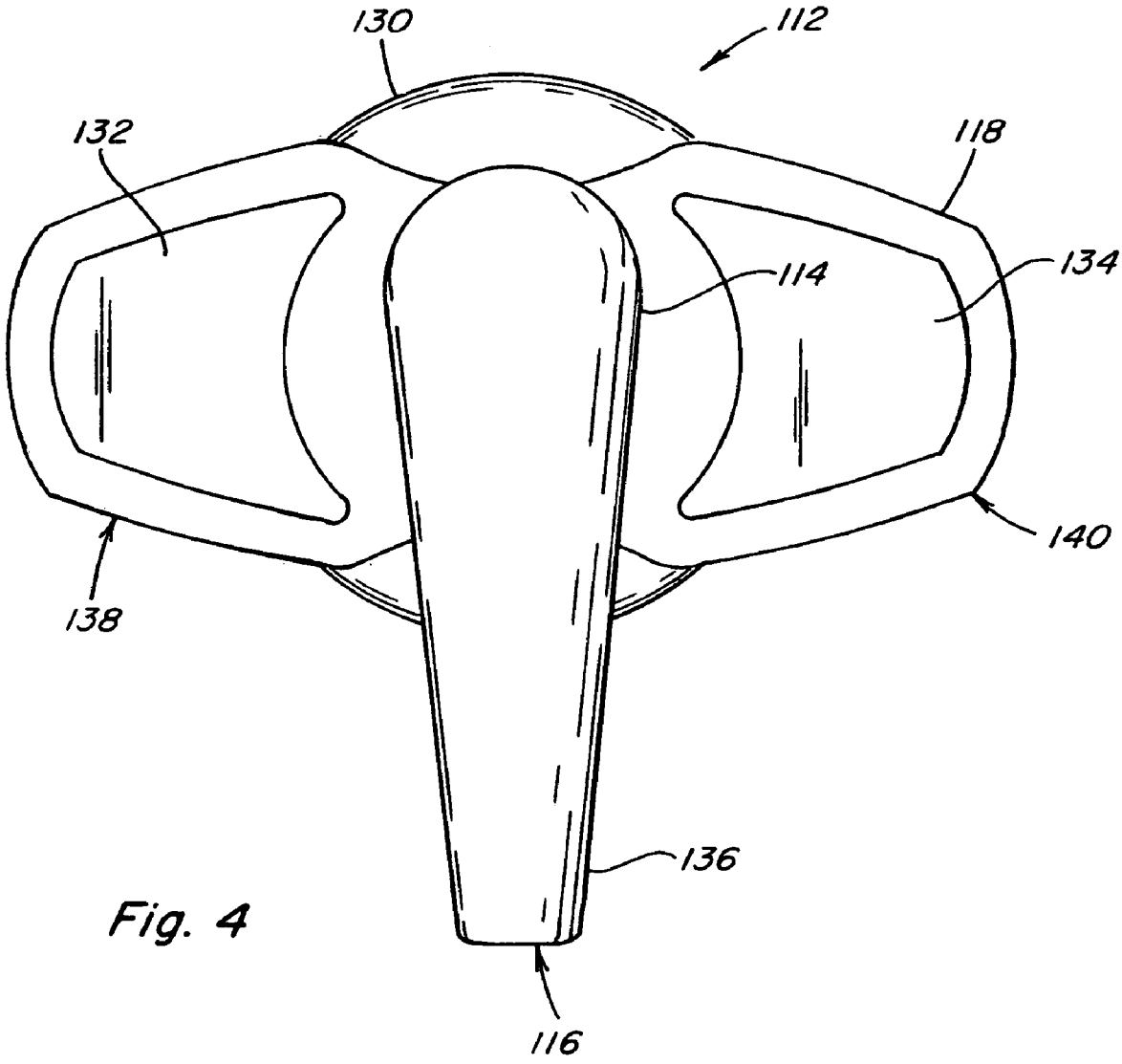
FIG. 4 is a top plan view of the pump dispenser of the embodiment shown in FIG. 3.

FIGS. 3 and 4 illustrate a second embodiment of the pump dispenser, generally indicated by numeral reference 112. The pump dispenser 112 includes an arcuate or bow-shaped handle 118 which has two depression members. The arcuate shape of the handle 118 is significant because the convex upper surface allows excess water to roll off the handle 118, thereby improving the handle's non-slip characteristics. In the embodiment depicted in FIGS. 3 and 4, the depression members of the handle 118 are preferably provided with a first gripping surface 132 and a second gripping surface 134, respectively, but are not a requirement of the invention. As an example, the gripping surfaces 132, 134 may be an elastomeric coating, such as a rubberized coating. The gripping surfaces 132, 134 provide a textured-surface by which the user can achieve a more secure contact to depress the handle 118 by using his or her fingers.

The handle 118 may be flat, arcuate, or some other shape. In the embodiment depicted in FIGS. 3 and 4, the handle 118 is slightly arcuate. The depression members of the handle 118 are provided by a first paddle 138 and a second paddle 140. The paddles 138, 140 are each adapted to receive a user's finger. In some embodiments, the gripping surfaces 132, 134 are mounted to the paddles 138, 140. However, the paddles 138, 140 may have no coating or other surface modification at all. A user may depress the paddles 138, 140 to actuate the pump dispenser 112. Additionally, in the depicted embodiment, the pump dispenser 112 includes an actuator head 114, and a head extension 136 extends from the actuator head 114. The head extension 136 is hollow and is in fluid communication with the actuator head 114. The head extension 136 terminates at the spout 116.

Figure 5:
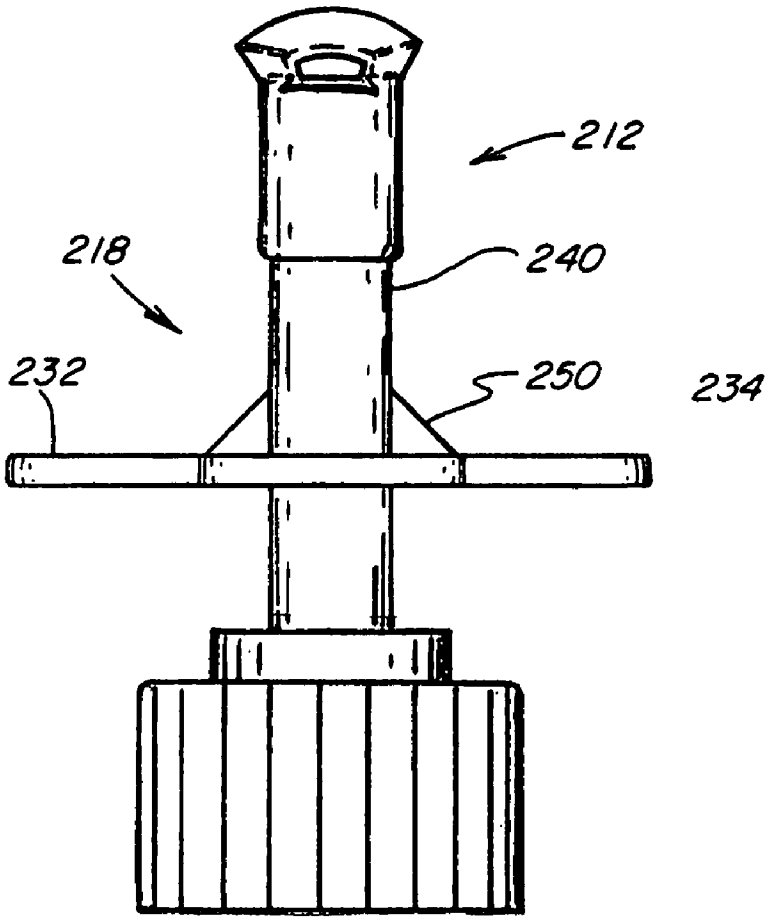
FIG. 5 is a front elevation view of a pump dispenser of the present invention in a third embodiment.

FIG. 5 illustrates a third embodiment of the pump dispenser, generally indicated by numeral reference 212. The pump dispenser 212 includes a handle 218 connected to a stem 240. In the embodiment depicted in FIG. 5, the handle 218 is planar. The handle 218 includes a first depression member 232 and a second depression member 234. The first depression member 232 is horizontally opposed to the second depression member 234. In some embodiments, a gusset 250 may be used to connect the handle 218 to the stem 240.

Figure 6:
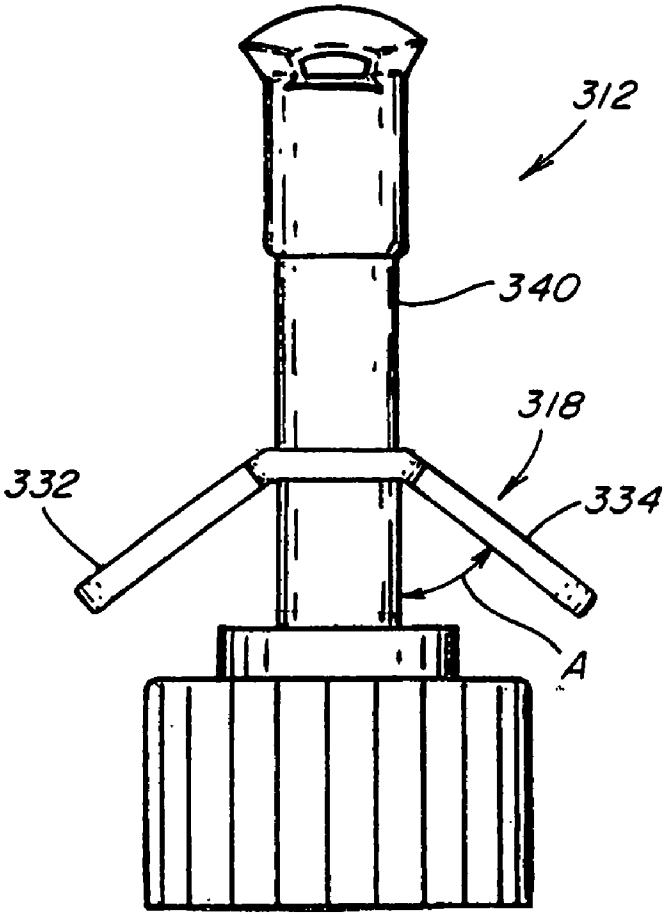
FIG. 6 is a front elevation view of a pump dispenser of the present invention in a fourth embodiment.

FIG. 6 illustrates a fourth embodiment of the pump dispenser, generally indicated by numeral reference 312. The pump dispenser 312 includes a handle 318 connected to a stem 340. In the embodiment depicted in FIG. 6, the handle 318 is at an angle A to the stem 340. The angle A is preferably thirty degrees but other angles may be used. The handle 318 includes a first depression member 332 and a second depression member 334.

Figure 7:
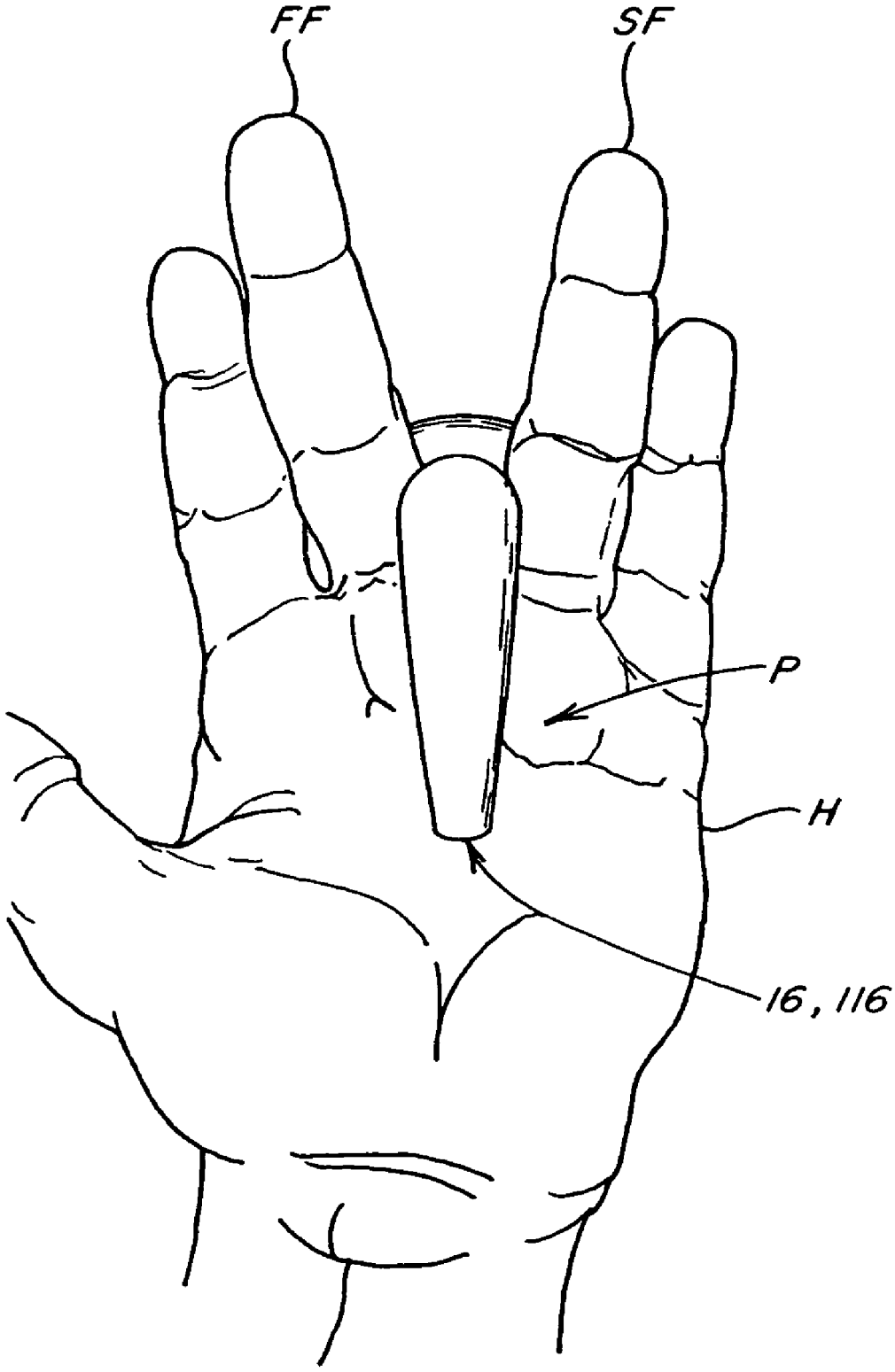
FIG. 7 is a top plan view of a fluid dispenser incorporating an embodiment of a pump dispenser in use.

In operation, a user places his or her hand H (e.g., shown in FIG. 7) next to the pump dispenser 12, 112, 212, 312. The user places his or her hand palm-up with his or her palm P under or near the spout 16, 116. The user places his or her hands on the handle 18, 118, 218, 318. In the depicted embodiment, the user places a first finger FF over a first depression member 32, 132, 232 and a second finger SF over a second depression member 34, 134, 234, 334. The user depresses the handle 18, 118, 218, 318 to receive dispensed fluid at the spout 16, 116.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of operating a fluid dispenser, said method comprising the steps of:

providing a pump dispenser connected to a container, said pump dispenser having an actuator head with a spout, said spout defining an opening therein oriented in a first direction, a stem connected to said actuator head, and a handle connected to said stem, said handle having at least one first depression member and at least other depression member, and said container containing a fluid;

placing a first finger of a user's hand over said at least one first depression member;

placing a second finger of said user's hand over said at least one other depression member;

depressing said handle with said first finger and said second finger in said first direction;

withdrawing at least a portion of said fluid from said container; and dispensing at least a portion of said fluid at said spout in said first direction onto said user's hand.

* * * * *